United States Patent [19]

Dömök et al.

[11] 4,152,829

[45] May 8, 1979

[54] CLOTH CUTTER WITH SHARPENER AND CLOTH CONTACTING PARTS ARE TEFLON COATED

[75] Inventors: István Dömök; Olivér Kocsis; Miklós Bànszki; Jenó Horvàth, all of Budapest, Hungary

[73] Assignee: Csepel Muvek Jarmu- Es Konfekcioipari Gepayara, Budapest, Hungary

[21] Appl. No.: 882,898

[22] Filed: Mar. 2, 1978

[30] Foreign Application Priority Data

May 4, 1977 [HU] Hungary ..... CE 1131

[51] Int. Cl.[2] ..... B26B 7/00

[52] U.S. Cl. ..... 30/139; 30/275

[58] Field of Search ..... 30/138, 139, 273, 275

[56] References Cited

U.S. PATENT DOCUMENTS

| | | | |
|---|---|---|---|
| 2,149,731 | 3/1939 | Greenbaum | 30/138 |
| 2,526,779 | 10/1950 | Stevenson | 30/273 X |
| 2,748,473 | 6/1956 | Carapucci | 30/139 |
| 2,790,235 | 4/1957 | Clark | 30/139 |
| 2,945,332 | 7/1960 | Gury | 30/138 X |
| 2,952,913 | 9/1960 | Clark | 30/275 |

*Primary Examiner*—Jimmy C. Peters
*Attorney, Agent, or Firm*—Young & Thompson

[57] ABSTRACT

The invention relates to a cloth-cutting machine with a sword-knife, provided with a band sharpening device, an elastic hold-down and all the parts being in contact with the cloth sheet to be cut are coated with an anti-friction polytetrafluorethylene coating. The machine is driven by an electromotor and can be characterized in that in the sharpening head band tensioning arms are arranged, on said arms changeable heads are mounted, furthermore the machine is provided with a control spindle performing regulation by means of a tension spring and a nut bolt. The rod pressing the cloth in an elastic manner is provided with the toothed retaining member, the casing leading the same, with the spring built into said casing, with a retaining lever, a further spring and with an arm for the release of the retaining member.

The machine according to the invention ensures excellent quality of the cloth-sheet cut, economical operation of the machine and reduced display of physical strength.

2 Claims, 4 Drawing Figures

CLOTH CUTTER WITH SHARPENER AND CLOTH CONTACTING PARTS ARE TEFLON COATED

Figure 1:
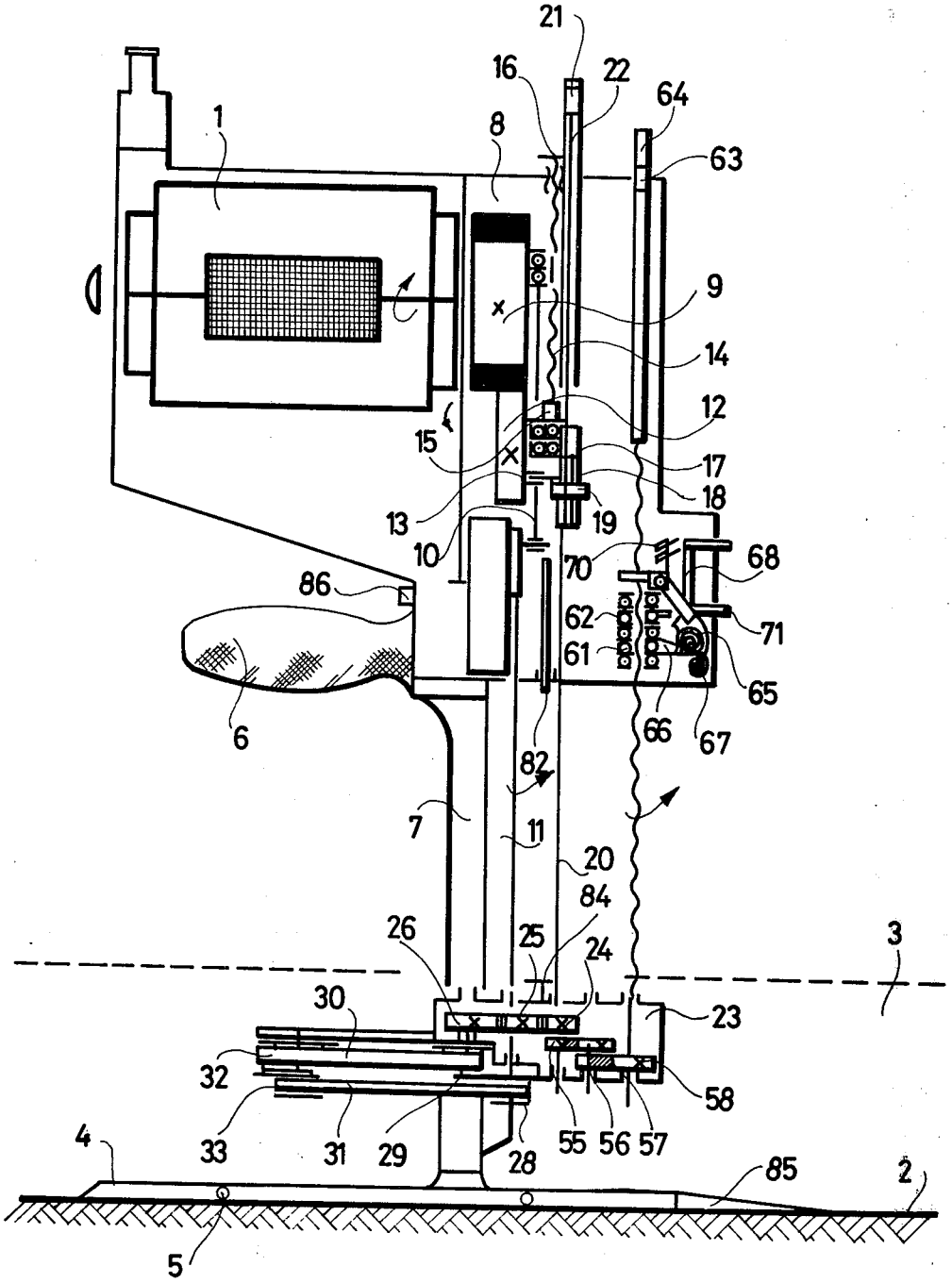

The invention relates to a cloth-cutting machine for the garment trade, provided with a sword-knife and an automatic band sharpening device, by means of which the sharpening angle of said knife and the pressure for tensioning the band can be expediently controlled. The hold-down following the unevenness of the cloth sheet and all other parts being in contact with the cloth sheet to be cut are provided with a anti-friction teflon coating, thus requirement of manual feeding force can be reduced.

Several types of cloth-cutting machines with sword-type knives are known, provided with band sharping machines, grind stones or friction discs, all apt for performing cloth-cutting.

Such a type has been described in the East-German Pat. No. 88 924. The American producers Wolf Beawer, Hoog's, the Japanese Hitaka, Kamakura, The French factory ETWA and West-German factories /Krauss u. Reichert, Bulimer etc./ have been producing among others the types mentioned.

The drawback of said cloth-cutting machine lies in that neither the angle of sharpening nor the pressure serving for tensioning the band can be controlled and in course of the knife wear the angle of re-sharpening also changes.

As a consequence, when cutting the cloth sheet composed of different materials and cloths, the manual feeding force needed for the cutting-process will change too and due to the frequent re-sharpening, the useful life of the knife will be shortened.

A further drawback of the cloth-cutting machines lies in that in order to avoid desintegration of the cloth sheet, the cloth sheet is hold down by means of a clamping foot, the surfaces of which, being in contact with the cloth, are polished or bringht-chromed.

As a consequence, during cloth-cutting, when performing feeding, the different cloth are clamping the cloth pressing foot—not being able to rise—in a different way; under the influence of the frictional force arising between the surfaces of the cloth-cutting machine and the material of the cloth sheet, the feeding force required will considerably increase, rendering the cloth-cutting process into a wearisome work requiring a serious display of physical strength.

The aim set has been to develop a solution by the aid of which the sharpening angle of the knife, complying to the material of the cloth sheet to be cut and adjustability of the optimal and economical sharpening conditions by means of the sharpening device could be ensured. By the convenient shaping of the clamping foot mechanism and by coating the surface of the machine being in contact with the cloth sheet with anti-friction polytetrafluorethylene, the requirement of manual feeding force can be considerably reduced; all the requirements can be complied with by using the simple, easy manageable, cheap mechanical elements and the surface-coating mentioned, yielding high-grade operational safety.

The aim set has been achieved by using a cloth-cutting machine with a sword-knife, provided with an automatic band sharpening device, with an elastic clamping foot and a suitable anti-friction teflon coating on the surfaces contacting the cloth sheet to be cut. The machine incorporates a crank mechanism ensuring the vertical alternating movement of the knife. The foot guiding the knife is also coated with teflon. The rolls supported in springs serve for moving the machine on the table. The tilting plate—also covered with teflon—enabling the slipping movement under the cloth sheet, the foot and the clamping rod connected to said foot and performing a performing springy movement during the cutting process, are forming one single unity. The band sharpening head is driven by the flywheel of the machine through machanical transmissions; in the sharpening head a compression spring ensuring band pressure, the device for the control of the spring force of said spring, as well as arms are arranged, the latter ones are moving alway perpendicularly to the plain of the knife and transfer the spring force to both bands to an equal extent; on the end of said arms heads complying with the material to be cut are mounted always under a constant angle.

Figure 2:
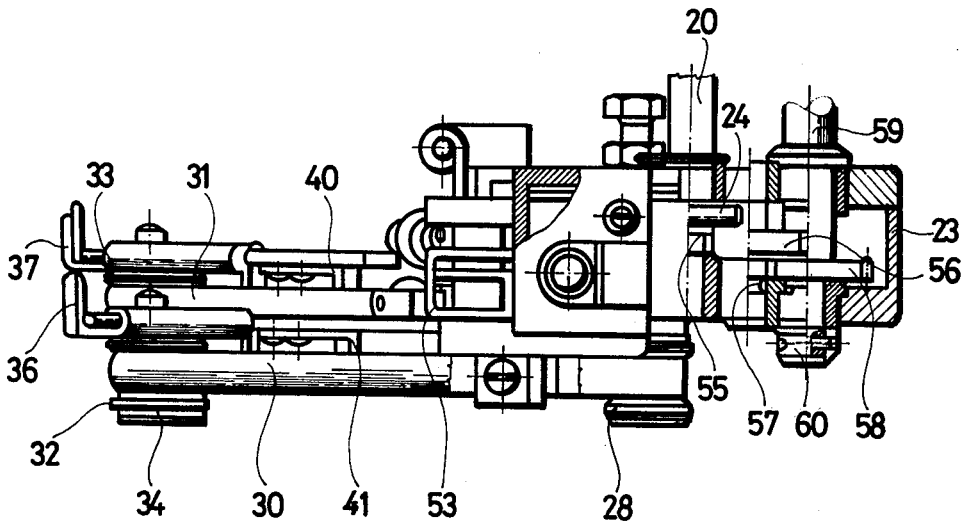
Figure 3:
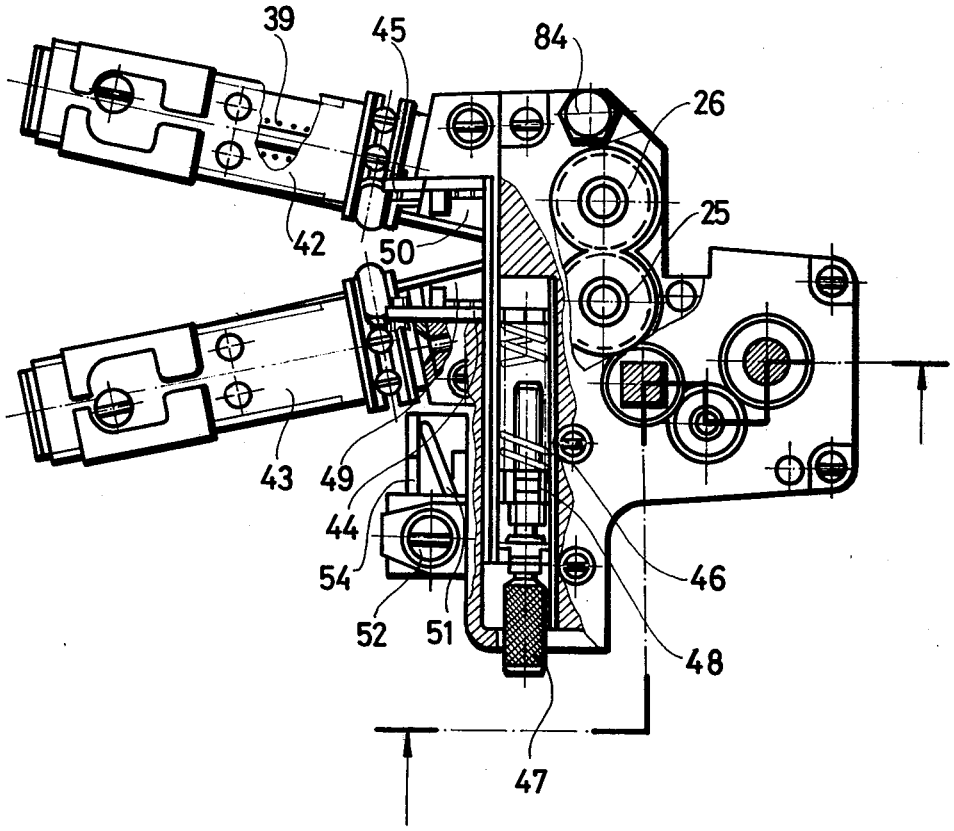
Figure 4:
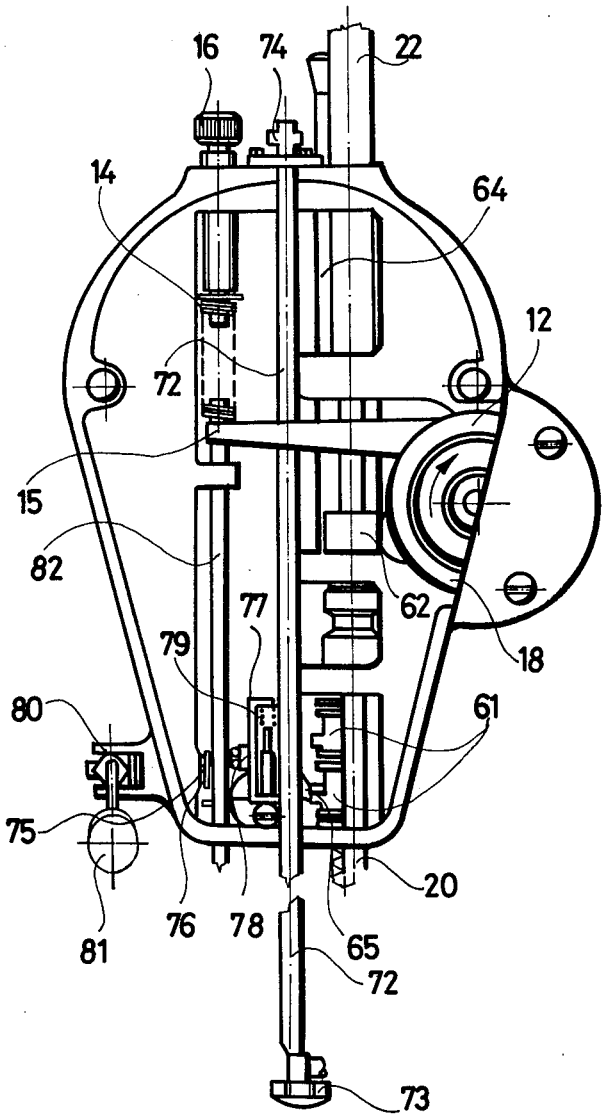

The invention will be described in details by means of a preferable embodiment, by the aid of the drawings enclosed, where FIG. 1 is showing the kinematic scheme of the cloth-cutting machine according to the invention, FIG. 2 illustrates the part-sectioned side view of the sharpening head of the cloth-cutting machine according to FIG. 1, FIG. 3 illustrates the part-sectioned top view of the sharpening head according to FIG. 2, FIG. 4 is showing the mechanical formation of the clamping foot of the cloth-cutting machine according to FIG. 1, The cloth-cutting machine is driven by the motor 1 serves for cutting the cloth sheet arranged on the table 2. The machine is put into motion by means of the handle 6 and moves on the rolls 5 connected through the leaf spring to the carrying plate /FIG. 1/.

The driving motor 1 / a three-phase asynchronous motor/ is built in the casing 8, on the casing 8 there is the foot 7 arranged being connected to the carrying plate 4 provided with the rolls 5. The crank mechanism 10 is connected to the flywheel 9, said mechanism ensuring the cutting speed of the knife 11 guided in the foot 7 and performing an alternating vertical movement.

The friction gear 12 moved by means of the spring 14 around the pin 13 can be tilted to the side of the flywheel 9 by the friction gear house 15. The screw spindle 16 controls the force of the spring 14 and thus regulates the surfacial pressure between the flywheel 9 and the frictional gear 12. The frictional gear 12 rotates the helical gear 17 arranged on the same axle and is engaged with the drive containing the spiral gears 18, 19. The spiral gear is provided with a handle and rotates the axle 20 having a square cross-section, by its inner rifling. The axle 20 is guided by means of the plug 21 fixed onto the upper end of the same and by the tube 22, while the lower end is connected by means of a screw-thread to the axle of the driving gear 24 of the sharpening head 23. The driving gear 24 engages with the spur gear 25, while the spur gear 26 engages with the spur gear 25. Onto the axle of the spur gears 25 and 26, respectively, the discs 28 and 29, respectively, are fixed, which drive the sharpening bands 30, 31, arranged on the free pulleys 32, 33. The free pulleys 32, 33 are supported in needle roller bearings and are provided with the carrier pins 34 riveted to the slip joints 36, 37. The slip joints 36, 37 are provided with the springs 39, the other end of said springs are bearing up against the brackets 40, 41; said brackets are riveted to the arms 42,43 fixed by means of a screw to the sharpening head 23. On the lateral part of the sharpening head 23 to band tensioning arms 44, 45—provided with the spanner spring 46—are arranged, sliding in the guide formed thereon, whereas the force of said spanner spring can be adjusted by means of the spindle 47 and the nut bolt 48, while the extent of tension is indicated by the pointer led in the groove of the sharpening head 23 and moved by means of the nut bolt 48.

The heads 49 and 50 are fixed by means of screws onto the band tensioning arms 44,45; the plane angle of the heads 49, 50 yields the sharpening angle, whereas by changing the same the sharpening angle desired can be accurately adjusted. The spring 51 is connected to the toothed side of the band tensioning arm 44, said spring bearing up against the plate 53 fixed by means of the pin 52. When performing sharpening, the spring 51 is pressing the toothed retaining lever 54 rotating on the pin 52, ensuring that the lower band should be able to get under the upper dead centre of the lower cutting edge of the knife 11.

The driving gear 24 is fixed onto the axle of the helical gear 55 by means of a tapered dowel; the helical gear 55 engages with the gear 56 which is fixed onto the axle of the gear 57 by means of a further tapered dowel. The gear 57 drives the helical gear 58 which is transmitting the decelerated rotary motion of constant sense to the screw spindle 59 connected. On the screw spindle 59 a flat right-hand therad with double start and a flat left-hand thread with double start is formed. The lower end of the screw spindle 59 is supported in bearings in the sharpening head 23 and is limited by the retainer ring 60 which is fixed onto the lower end of the axle by means of a tapered dowel.

Furthermore, on the screw spindle 59 the eye nut bolt 61 with a flat left-hand thread with double start and the eye nut bolt 62 with the flat right-hand thread with the double start are arranged, both supported in bearings in the casing 8. The plug 63 is connected by threads to the upper end of the screw spindle 59 and when sliding in the tube 64, it ensures expedient guiding.

When turned by the pin 66, the eyes of the nut bolts 61 and 62, respectively, can be butted on alternatively by means of the rocker arm 65. The flat spiral 67 is connected to the pin 66, the other end of the said spring being fixed in the casing 8. The actuating lever 68 is fixed to the rocker arm 65 by means of the pinned screws and is blocked from above by the arm 71 to be tilted against the force of the spring 70.

To the lower end of the rod 72 crossing the casing 8 and led in the same the cloth pressing foot 73 is connected by means of bolts, on the upper end of the same the lifting handle 74 has been fixed. The spring 76 on the retaining lever 75 presses the toothed retaining member 78 through the casing 77 of the retaining member 78 to the toothed side of the rod 72. In the casing 77 the spring 79 is pressing the toothed retaining member 78 downwards. On the outside of the casing 8 there is the lever 81 arranged serving for the release of the retaining member, said lever may be rotated on the pinned screw 80 and it is pivotally connected to the retaining lever 75.

In the inside of the casing 8 the pressing bar 82 is led in the bore with a vertical axis, the bar is ensured against falling out by means of the split-pin; on the bottom of the casing 8 the releasing bracket is fixed by mens of screws. On the upper part of the sharpening head 23, below the pressing bar 82 a hexagonal bolt is connected to the threaded bore. The carrying plate 4, the tilting plate 85, the foot 7 and the cloth pressing foot 73 are coated with anti-friction polytetrafluorethylene.

The cloth-cutting machine with the swordknife operates, as follows:

After having switched the motor 1 by using the double-throw switch 86 to the supply voltage, the crank mechanism is put into a rotary movement through the flywheel 9, whereby the knife 11 begins to perform an alternating movement.

The machine is pushed to the cloth sheet to be cut by means of the handle 6 and after having pressed the lever 81 serving for the release of the retaining member, the cloth pressing foot is raised by the rod 72.

As already told before, the machine is pushed foreard by means of the handle 6 and cutting of the cloth sheet 3 in accordance with the cut pattern may be begun. In case if the surface of the cloth sheet 3 became wrinkled before the cloth pressing foot 73, the power impulse resulting may rise the foot 73 without having released the connection between the rod 72 and the toothed retaining member 78, as a consequence, it may move upwards together with the rod 72 and the retaining member 78 against the spring force of the spring 79. After having passed over the surfacial wrinkling of the cloth sheet 3, the cloth pressing foot is returned by means of the spring 79 in its lower position. By following the surface of the cloth sheet 3, the cloth pressing foot is hindering the desintegration of the cloth sheet during the cutting process.

The sharpening device is put into action by pressing the actuating lever 68, when the cloth pressing foot is staying in its lower position. In this position butting on of the nut bolt 61 with the flat left-hand thread with double start takes place by means of the rocker arm 65, simultaneously the arm 71 is blocking the rocker arm 65 by means of the spring 70; by turning off the pin 66, the flat spiral spring gets into a tensioned state.

Simultaneously the spring 14 is tilting by the aid of the casing 15 the friction gear 12 onto the flywheel 9, and after having moved the pressing bar 82 downwards, the pressing bar is transmitting an impulse to the sharpening head 23 through the hexagonal bolt 84. Under the influence of the impulse and after having put the drive into action, the sharpening head 23 begins to move wownwards, under the influence of the spring 46 the band tensioning arms 44, 45 are pressing from both sides simultaneously the rotating bands onto the edge of the knife 11, at the same time the toothed reatining lever 54 moved by the force of the spring 51 is blocking the band tensioning arm 44. The friction gear 12 turns the helical gear 17, whicn in turn rotates the spiral gears 18, 19. The spiral gear 19 is rotating the axle 20 having a square cross-section and said axle is sliding in the rifled bore of the spiral gear 19 and drives through the driving gear 24 of the sharpening head 23 the spur gears 25, 26. The spur gears 25, 26 are driving the sharpening bands 30, 31 by means of the discs 28, 29. At the same time the catching device and the screw spindle moved downwards by the butted nut bolt 61 with the left-therad receive a permanent drive through the decelerating transmission of the gears 55,56 and 57,58 respectively.

In the lowest dead centre the plug mounted onto the upper end of the screw spindle 59 is pressing the retaining lever 71 against the spring 70, as a consequence, the rocker arm 65 is tilted back by the flat spiral spring 67, butting on of the nut 62 with the flat right-hand thread takes place, simultaneously the nut bolt with the flat left-hand thread is released. The nut bolt 62 with the righ-hand thread is forcing the screw spindle 59 with the permanent sens of rotation to a rising movement, as a consequence, the sharpening head 23 will also rise. In its upper position said head is reaching the pressing bar 82 and presses the same with the hexagonal bolt together upwards. The casing 15 is tilting away the friction gear 12 from the flywheel 9, driving is ceased and the spring gets into a pressed state. Simultaneously, the releasing bracket mounted on the bottom of the casing 8 stops by turning the toothed retaining lever 54 on the pin 52 the blocked state of the hand tensioning arm 44, and removes the band tensioning arms 44,45 from the knife 11. The motor is switched off by means of the double-throw switch 86 and thus the machine comes to rest.

Manipulation of the cloth-cutting machine according to the invention is easy, the construction is composed of known machine elements. The band-sharpening device can by simultaneously controlled, in course of resharpening a constant angle of sharpening, as well as a stepless pressure for the sharpening of the band can be ensured. The easily controllable and optimal adjustment of degree of fineness of the grinding band and material of the knife can be achieved.

By following the cloth sheet with the cloth pressing foot mechanism in an elastic manner, as well as by applying an anti-friction polytetrafluorethylene coating, the requirement of manual feeding force can be minimized.

Taking into consideration that we are talking about an equipment used in production, the quality of the cloth sheet cut, economical operation of the machine and reduced display of physical strength are of utmost importance.

By using the machine according to the invention all requirements can be complied with.

The machine is completely mechanical and due to the simplicity of elements, decrease in production costs becomes possible.

What we claim:

1. Cloth-cutting machine with a sword-knife, driven by an electromotor and provided with a band sharping device and with components being in contact with the cloth-sheet to be cut, f.i. with a carrying plate, a tilting plate, a foot and a cloth pressing foot, characterized in that in the sharping head (23) band tensioning arms (44,45) are arranged, and on said arms the changeable heads (49,50) are mounted, furthermore the machine is provided with a control spindle (47) which is performing regulation by means of a tension spring (46) and a nut bolt (48), while the rod (72) pressing the cloth in an elastic manner is provided with the toothed retaining member (78), with the casing (77) leading the same, with the spring (79) built into the casing (77), with the retaining lever (75), a further spring (76) and with an arm turnable on the pinned screw (80) and serving for the release of the retaining member (78).

2. Cloth-cutting machine as claimed in claim 1, characterized in that the carrying plate (4), the tilting plate (85), the foot (7) and the cloth pressing foot (73) are coated with polytetrafluorethylene.

* * * * *